US007017900B2

(12) United States Patent
Dobrindt

(10) Patent No.: US 7,017,900 B2
(45) Date of Patent: Mar. 28, 2006

(54) TRANSPORTING AN ESSENTIALLY SHEET-SHAPED ELEMENT, PARTICULARLY A PRINT MATERIAL SHEET

(75) Inventor: Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/790,425

(22) Filed: Mar. 1, 2004

(65) Prior Publication Data

US 2004/0256798 A1 Dec. 23, 2004

(30) Foreign Application Priority Data

Mar. 17, 2003 (DE) ..... 103 11 858

(51) Int. Cl.
*B65H 29/00* (2006.01)

(52) U.S. Cl. ..... 271/187; 271/315; 198/441; 198/459.2

(58) Field of Classification Search ..... 271/109, 271/315, 187; 198/441, 459.2
See application file for complete search history.

(56) References Cited

U.S. PATENT DOCUMENTS

| | | | | |
|---|---|---|---|---|
| 1,949,152 | A | 2/1934 | Frankboner | 271/80 |
| 2,026,162 | A * | 12/1935 | De Manna | 271/315 |
| 2,031,136 | A * | 2/1936 | Sewick | 271/315 |
| 4,537,390 | A * | 8/1985 | Kiamco et al. | 270/58.29 |
| 4,901,996 | A * | 2/1990 | Schlough | 271/10.06 |
| 5,046,711 | A * | 9/1991 | Merwarth et al. | 271/11 |
| 5,065,997 | A * | 11/1991 | Butts et al. | 271/187 |
| 5,174,561 | A * | 12/1992 | Lebeau | 271/186 |
| 5,476,256 | A * | 12/1995 | Fortuna et al. | 271/187 |
| 5,590,753 | A * | 1/1997 | Bertschi et al. | 198/441 |
| 5,692,740 | A * | 12/1997 | Holtje | 270/58.01 |
| 5,803,705 | A * | 9/1998 | Keyes | 414/793.9 |
| 5,975,525 | A * | 11/1999 | Hartmann et al. | 271/315 |
| 6,019,209 | A * | 2/2000 | Hara et al. | 194/206 |
| 6,216,591 | B1 * | 4/2001 | Nanba | 101/232 |
| 6,270,073 | B1 * | 8/2001 | Landwehr | 271/187 |
| 6,283,354 | B1 * | 9/2001 | Hirota et al. | 227/39 |
| 6,331,000 | B1 * | 12/2001 | Beskitt et al. | 271/3.01 |
| 6,511,065 | B1 * | 1/2003 | Cote et al. | 271/270 |
| 6,554,273 | B1 * | 4/2003 | Holland-Letz et al. | 271/176 |

FOREIGN PATENT DOCUMENTS

| | | |
|---|---|---|
| EP | 0 838 421 B1 | 8/2000 |
| JP | 2002-104703 A | 4/2002 |

* cited by examiner

*Primary Examiner*—Donald Walsh
*Assistant Examiner*—Thomas Morrison
(74) *Attorney, Agent, or Firm*—Lawrence P. Kessler

(57) ABSTRACT

Transporting an essentially sheet-shaped element, particularly for transporting a print material sheet in a printing press in which the sheet-shaped element is taken hold of by at least one rotating transport having at least one mouth-like receptacle for introducing the front-edge region of the sheet-shaped element at a grasping location in its front-edge region, entrained up to a delivery location and delivered there, the sheet-shaped element being bent during the entraining over a rotation or curvature radius. The sheet-shaped element is taken hold of by at least one grasping device in the region of the mouth-like receptacle, particularly actively and in a compulsory manner.

8 Claims, 4 Drawing Sheets

TRANSPORTING AN ESSENTIALLY SHEET-SHAPED ELEMENT, PARTICULARLY A PRINT MATERIAL SHEET

CROSS-REFERENCE TO RELATED APPLICATIONS

U.S. patent application Ser. No. 10/790,426, filed on Mar. 1, 2004, by Dobrindt, entitled, "TRANSPORTING AN ESSENTIALLY SHEET-LIKE ELEMENT, PARTICULARLY IN A PRINTING PRESS";

U.S. patent application Ser. No. 10/790,155, filed on Mar. 1, 2004, by Dobrindt, entitled, "APPARATUS FOR TRANSPORTING A SHEET-LIKE ELEMENT";

U.S. patent application Ser. No. 10/789,009, filed on Mar. 1, 2004, by Goldbeck, entitled, "CONVEYING AN ESSENTIALLY SHEET-SHAPED ELEMENT, IN PARTICULAR, A SHEET OF PRINTING MEDIUM"; and U.S. patent application Ser. No. 10/790,564, filed on Mar. 1, 2004, by Dobrindt, entitled, "CONVEYING AN ESSENTIALLY SHEET-SHAPED ELEMENT, IN PARTICULAR, A SHEET OF PRINTING MEDIUM".

FIELD OF THE INVENTION

The invention relates to transporting an essentially sheet-shaped element, particularly for transporting a print material sheet in a printing press, in which the sheet-shaped element is taken hold of by at least one rotating transport with at least one mouth-like receptacle for introducing or inserting the front-edge region of the sheet-shaped element at a grasping location in its front-edge region, entrained up to a delivery location and delivered there, the sheet-shaped element being bent during the entraining over a rotation or curvature radius.

BACKGROUND OF THE INVENTION

A method and apparatus for transporting sheet-shaped elements are known from DE 199 04 853. There, a so-called stacking wheel is used as a rotating transport for transporting and depositing bank notes, in particular. The bank notes are introduced individually into mouth-like receptacles and attached there. To ensure that bank notes are attached securely, blades limiting the mouth-like receptacles are coupled in an elastic manner in order to attain a radial force component directed inwards toward the wheel hub of the transport by which each respective bank note is squeezed in the mouth-like receptacle. Here, it must be taken into account that in order to securely take hold of a sheet-shaped element in the mouth-like receptacle, the element may not be pushed too deep into the receptacle, all the way to the stop, in order to avoid damage to the edge of the element caused by the stop. The known blade construction is relatively expensive mechanically and interference-prone, and is relatively unreliable since it is based on spring forces for taking hold of, transporting and depositing sheet-shaped elements.

SUMMARY OF THE INVENTION

The objective of this invention is to increase the reliability in the transport and depositing process, particularly at higher transport speeds. This objective is solved according to the invention in that the sheet-shaped element is attached by at least one grasping device in the region of the mouth-like receptacle, particularly actively and in a compulsory manner. In this manner, the sheet-shaped element is securely held and transported and released for depositing at the proper destination.

In a beneficial manner according to a further development of the invention, the grasping device can also be used to move the sheet-shaped element in to or out of the mouth-like receptacle in that the sheet-shaped element is moved by the grasping device in the region of the mouth-like receptacle and relative thereto. It is provided preferably that the sheet-shaped element has a pressure, which acts in a squeezing manner applied to it by the grasping device in the mouth-like receptacle in order to hold it securely with simple means while at the same time not damaging it.

A preferred embodiment of the apparatus according to the invention provides that the grasping device is formed essentially as a cam disk which is rotatable around an axis which is parallel to the rotational axis of the transport and is supported on the transport such that the cam disk essentially closes the mouth-like receptacle in at least one relative rotational position with respect to the transport and essentially leaves the mouth-like receptacle open in at least one other relative rotational position. In this manner, a sheet-shaped element can be squeezed into the mouth-like receptacle purely mechanically and reliably in a pinching manner and re-released without being damaged, e.g., with the aid of a cam plate, this taking placed timed in a suitable manner with the transport and its pick up and delivery.

Here, the grasping device and the transport can be drivable in a rotating manner at a predetermined rotational speed ratio with respect to one another. If, for example, the grasping device is driven faster than the transport, the sheet-shaped element is actively drawn into the mouth-like receptacle after being taken hold of.

A next further development of the invention provides that a plurality of mouth-like receptacles are arranged equally distributed over a 360° angle with respect to the transport, in order to be able to transport several sheet-shaped elements simultaneously, or to be able to take hold of preferably at least the next sheet-shaped element for transport if the sheet-shaped element currently being transported is deposited, with two mouth-like receptacles lying diametrically opposed being provided for this purpose.

It can be provided beneficially that the ratio of the rotational speed of the transport to the rotational speed of the grasping device is set to 1:2, in which case, namely, if the grasping location and the delivery location are spaced at exactly one half revolution of the transport from one another. If the grasping device then turns twice as fast, then it makes in the same time a whole revolution from an opening position to a closing position and back to the opening position. It is clear that correspondingly other rotational speed ratios are attainable if the grasping location and the delivery location are positioned differently with respect to one another, if the grasping device has several opening and closing positions as a result of its form, and/or if additionally the grasping device is intended to ensure a relative motion of a sheet-shaped element in the mouth-like receptacle.

Moreover, it can be provided preferably that the at least one mouth-like receptacle is formed essentially as a slot or slit. Here, it can be taken into account in a beneficial manner that the length of the slot includes movement play for the front edge of the sheet-shaped element without the risk of pushing the front edge on the slot bottom. A relative movement of the sheet-shaped element in the mouth-like receptacle with the aid of the grasping device is simplified if the grasping device has a surface with a relatively high coefficient of friction and the mouth-like receptacle has at least one inner surface with a relatively low coefficient of friction with respect to the material of the sheet-shaped element.

At the delivery location, an output and depositing of the sheet-shaped element can take place in a simple manner in that in the region of the delivery location a fixed stop with respect to the transport is arranged for the front edge of the sheet-shaped element inserted in the receptacle against which the sheet-shaped element pushes, so that it gets free out of the mouth-like receptacle if the transport itself moves onward through the stop in an unimpeded manner. For this purpose, a rail can be provided which has a sufficient recess for the transport.

For better orientation of the sheet-shaped element during transport, preferably several transports are provided spaced coaxially from one another. Preferably, two transports are arranged in a mirror image with respect to a mirror plane perpendicular to the rotational axis.

BRIEF DESCRIPTION OF THE DRAWINGS

The drawings show an exemplary embodiment from which further inventive features can also ensue, but the invention is not restricted in its scope to this exemplary embodiment. The figures show the following schematically.

DETAILED DESCRIPTION OF THE INVENTION

Figure 1:
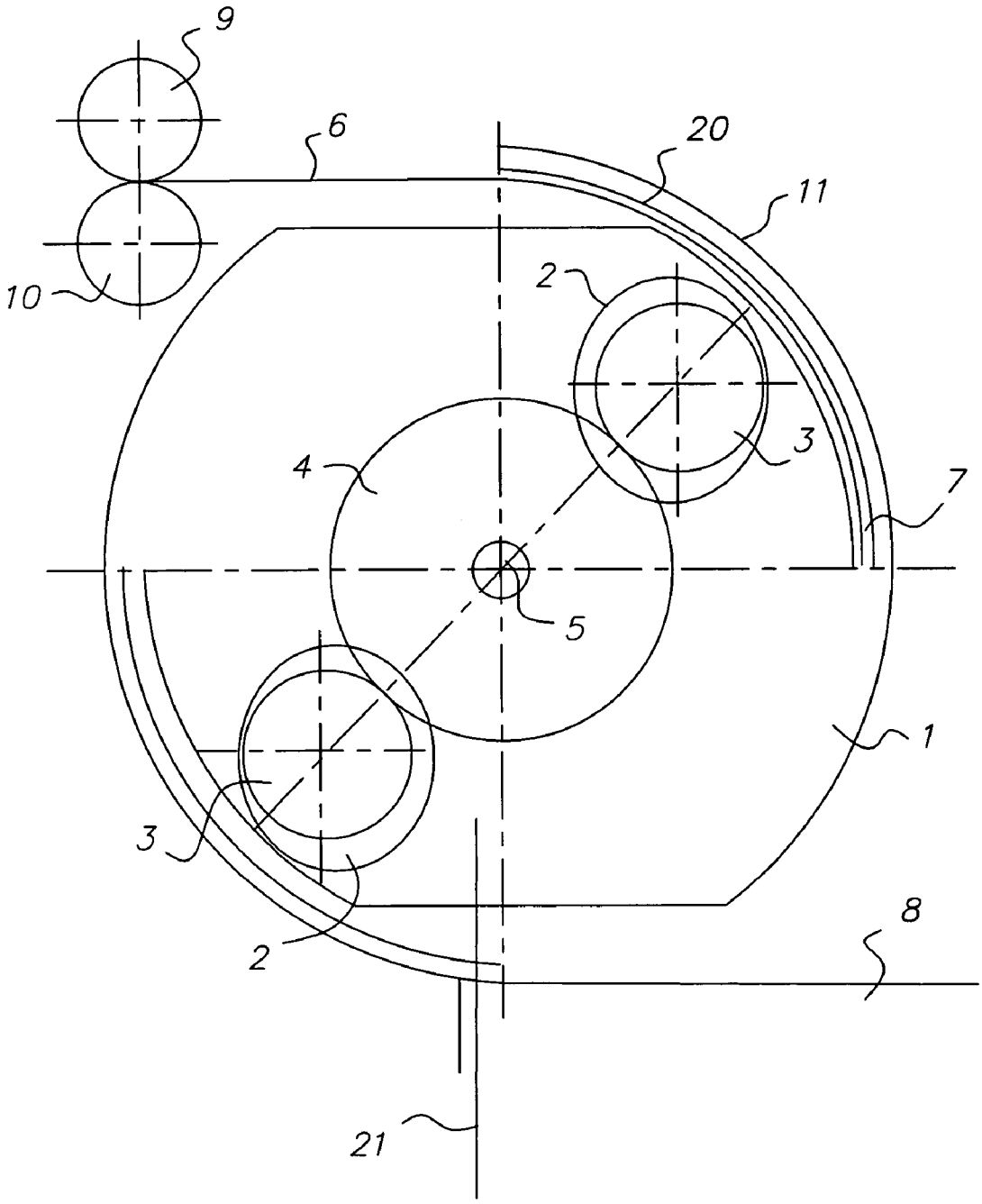
FIG. 1 is a lateral view of a transport according to the invention.

FIG. 1 shows a transport according to the invention in a lateral view. The transport is formed essentially as a deflection disk 1 rotating about an axis 5. Lying diametrically opposite to one another with respect to the axis 5, two slots 20 are arranged as mouth-like receptacles for picking up sheet-shaped elements 6. Sheet-shaped elements 6 are to be transported individually from a grasping location to a delivery location by the deflection disk 1 and, turned automatically, and deposited. In the region of the grasping location, a transfer to the deflection disk 1 takes place with the aid of transfer rolls 9, 10 at the end of a paper or print material path, preferably in the extension region of a printing press. Here, the sheet-shaped element 6 is pushed with its front edge into the waiting slot 20, but not too far where the front edge is damaged on the slot bottom 7. Principally, sheet-shaped elements 6 would be sufficiently fixed in each case in the slot 20 through insertion into the slot 20, bending the sheet-shaped element 6 over the disk member of the deflection disk 1 and a preferred spring-loaded movability of the slot outer wall 11 of the slot 20 during transport. This applies particularly in case of small-format, thin sheets of paper, such as bank notes. Larger sheets, such as the DIN A 3 format, and/or heavier and stiffer sheets, such as those with a paper weight of about 300 grams per square meter, are not sufficiently fixed, especially since the diameter of the deflection disk for such sheets (due to their length and/or stiffness) must be chosen to be greater, e.g., in the range of 90 millimeters.

Therefore, according to the invention, a further fixing mechanism is provided in the region of each slot 20, namely, preferably a rotating grasping device 2. This grasping device 2 is formed to be roll-like and is driven in a rotating manner via a gearwheel 3 which is interlocked with a gearwheel 4 linked to the deflection disk 1 so that, in other words, the rotation of the deflection disk 1 is transferred in a coupled manner to the grasping device 2 with a gearwheel drive 3, 4. Each grasping device 2 is formed in the way of a cam plate or a cam wheel deviating excentrically with respect to its axis of rotation from a circular shape so that it protrudes, depending on the rotational position, by a different distance into the slot 20. In particular, there is an opening position in which it releases the slot 20 for removal or insertion of a sheet-shaped element 6, and there is a closing position in which it takes hold of a sheet-shaped element 6 in the slot 20 and presses it in a squeezing manner against the slot outer wall 11.

The transfer ratio of the gearwheel drive 3, 4 is 1:2 so that the grasping device turns once in full for a half rotation of the deflection disk 1. The grasping device 2 is arranged here so that it reaches its opening position exactly when the slot 20, in its upper position takes a sheet-shaped element 6 and again when the slot, in its lower position delivers a sheet-shaped element 6, namely deposits it on a stack 8. During transport between these positions, the grasping device 2 reaches its closing position in which it holds tight the sheet-shaped element 6 in a squeezing manner. In the lower position of the slot 20 in which the grasping device 2 opens, the deflection disk 1 moves, without halting, through a stop rail 21 which forces the sheet-shaped element 6 out of the slot 20 so that it falls on the stack 8. Not shown since it is known, per se, the deflection disk 1 also can carry a type of rubber clip, which draws the sheet-shaped element 6, which was dropped on the pile 8 in a clean manner all the way to the stop rail 21.

Figure 2:
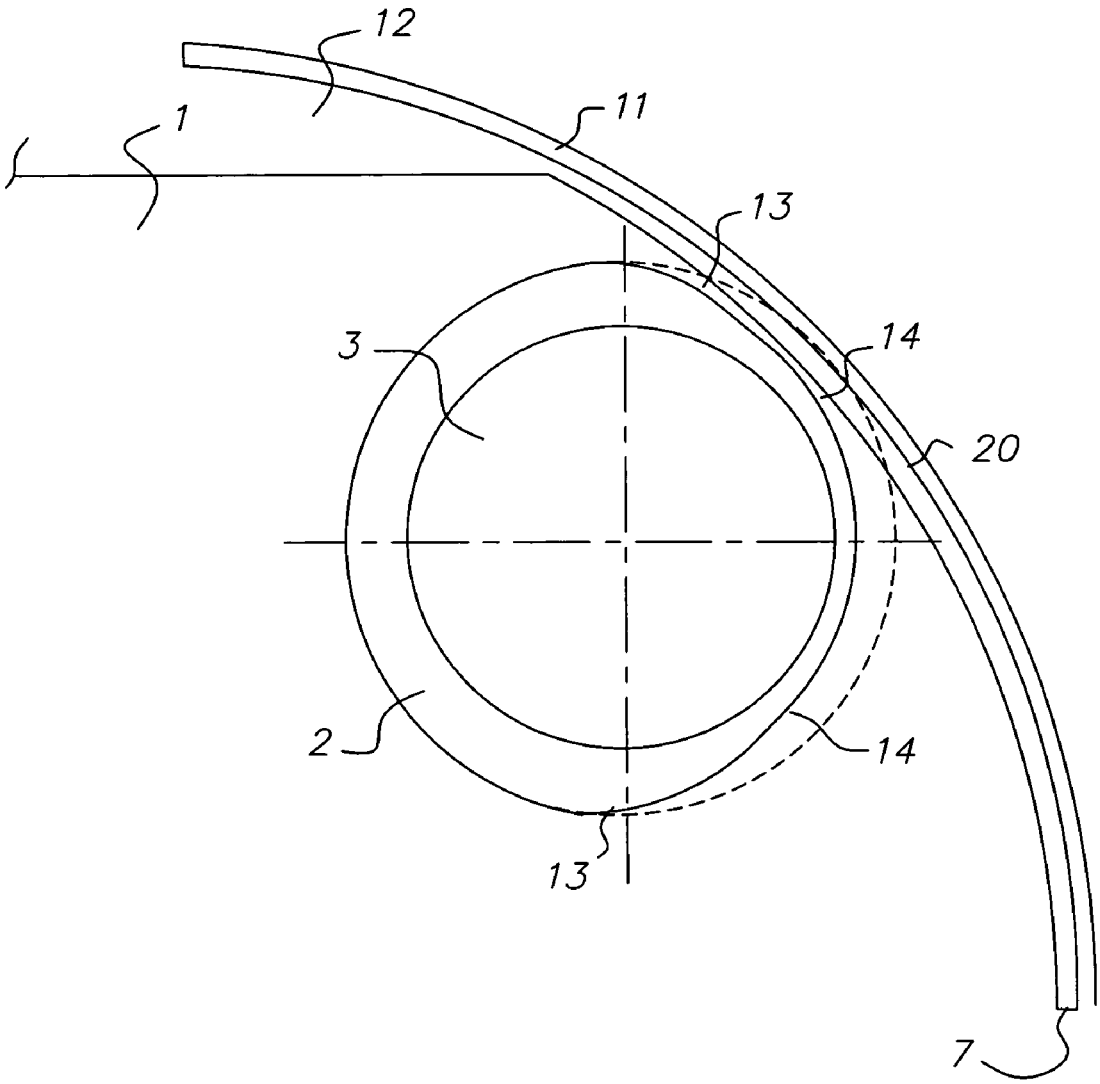
FIG. 2 is a section from the transport according to FIG. 1.

FIG. 2 shows an enlarged section of the transport according to FIG. 1. Identical components are given the same reference numbers as in FIG. 1, as is also the case in the other figures. What is seen is a section, which encompasses a slot 20 with a grasping device 2. In particular, the shape of the slot input of the slot 20 and of the grasping device 2 can be recognized better. The slot 20 has a pronounced, flattened, approximately funnel-like opening region 12 in order to simplify the threading in of a sheet-shaped element 6.

Figure 3:
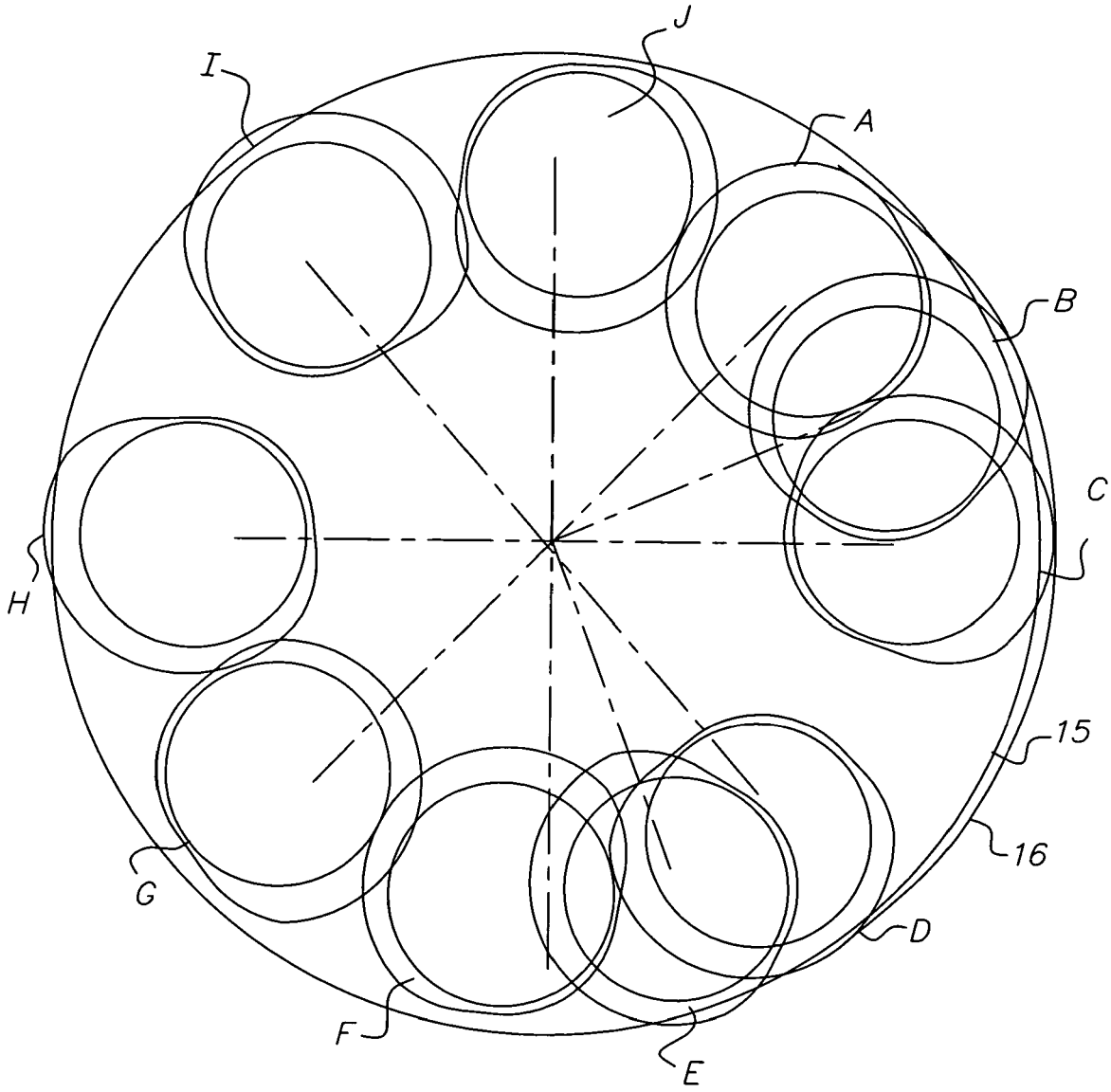
FIG. 3 is a rotational sequence of the transport according to FIG. 1.

In order to realize an opening position and a closing position, the grasping device 2 has its full radius on one side, whereas, on the other side it has material removed which leads via transition regions 13 to flattenings 14. FIG. 3 shows schematically a rotation scheme for the transport. It is shown what rotational positions A to J, in each case a grasping device 2 has for a complete revolution of the deflection disk 1 and, in particular, with respect to the inner radius region 15 and the outer radius region 16 of a slot 20, the opening and closing motion of the grasping device 2 being made clear. The positions A to J are thus phases, which follow one another in time in the rotation of the grasping device 2. It is recognizable that the grasping device 2 in the position J is already open for accepting a sheet-shaped element 6 into the slot 20 through a first flattening 14, and also in the position A is open through the second flattening 14 (see FIG. 2). In the position B, the slot 20 is somewhat closed through a transition region 13 and the sheet-shaped element 6 is contacted by the grasping device 2 and drawn in a frictionally engaged manner through the rotation of the grasping device 2 deeper into the slot 20. Before the front edge of the sheet-shaped element 6 reaches the slot bottom 7, the grasping device 2 reaches the closing position C, in which it clamps and fixes the sheet-shaped element 6. Over the rotational positions D and E, the grasping device 2 finally opens up again into the opening position F for delivering the sheet-shaped element 6 on the stack 8. Over the rotational positions G, H, and I, the grasping device necessarily closes and opens again but in a functionless manner since there is no longer a sheet-shaped element 6 in the slot 20. In the rotational position J, the grasping device 2 is then ready again for accepting a sheet-shaped element 6.

Figure 4:
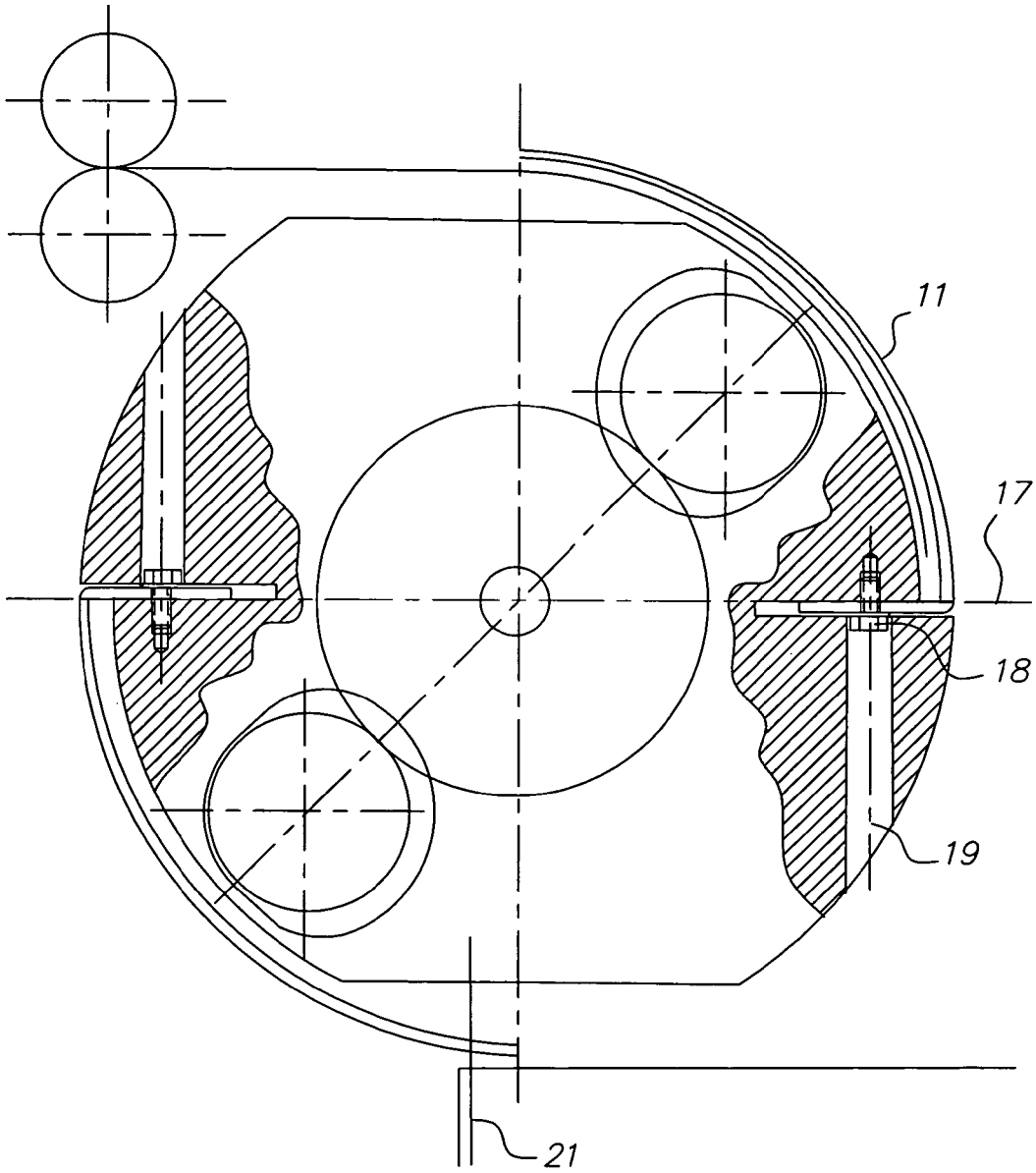
FIG. 4 is a partially sectional, lateral view of the transport according to FIG. 1.

FIG. 4 shows an enlarged, partially sectional, representation of the transport. From this, FIG. 4, it can be taken in particular that the slot outer walls 11 can be formed from spring tongues on one end, which are introduced in a beveled manner into slots 17 in the deflection disk 1, and are fastened there with fastening screws 18 which can be introduced and screwed in through reception bore holes 19.

The invention has been described in detail with particular reference to certain preferred embodiments thereof, but it will be understood that variations and modifications can be effected within the spirit and scope of the invention.

What is claimed is:

1. An apparatus for transporting an essentially sheet-shaped element, particularly for transporting a print material sheet in a printing press comprising: at least one rotating transport which transports a sheet-shaped element from a grasping location to a delivery location and delivers it there, said transport having at least one mouth-like receptacle for taking hold of and entraining the sheet-shaped element for introducing a front-edge of the sheet-shaped element, and including at least one flexional core which is at least fragmentarily present for bending the sheet-shaped element during the entraining over a rotation or curvature radius, at least one grasping device in the region of the mouth-like receptacle, said grasping device is a cam disk which is rotatable about an axis which is parallel to a rotational axis of said transport and is supported on said transport such that said cam disk closes said mouth-like receptacle in at least one relative rotational position with respect to the transport and leaves said mouth-like receptacle open in at least one other relative rotational position, and means for driving said grasping device and said transport in a rotating manner at a predetermined rotational speed ratio with respect to one another.

2. The apparatus according to claim 1, having a plurality of mouth-like receptacles arranged equally distributed over a 360° angle.

3. The apparatus according to claim 1, wherein the ratio of the rotational speed of said transport to the rotational speed of said grasping device is set to 1:2.

4. The apparatus according to claim 1, wherein said at least one mouth-like receptacle is formed as a slot, the length of said slot being such as to include movement play for the front edge of the sheet-shaped element without a risk of pushing the front edge on the bottom of said slot.

5. The apparatus according to claim 1, wherein said grasping device has a surface with a relatively high coefficient of friction, and said mouth-like receptacle has at least one inner surface with a relatively low coefficient of friction with respect to a material of the sheet-shaped element.

6. The apparatus according to claim 1, wherein, in the region of the delivery location, a fixed stop is arranged with respect to said transport for the front edge of the sheet-shaped element which is inserted in the receptacle.

7. The apparatus according to claim 1, wherein several transports are provided spaced coaxially from one another.

8. The apparatus according to claim 7, wherein two transports are arranged in a mirror image with respect to a mirror plane perpendicular to the rotational axis.

* * * * *